US008506328B2

(12) United States Patent
Mizutani et al.

(10) Patent No.: US 8,506,328 B2
(45) Date of Patent: Aug. 13, 2013

(54) CONNECTOR

(75) Inventors: Yoshihiro Mizutani, Yokkaichi (JP); Hiroko Kato, Yokkaichi (JP); Shinji Hirano, Yokkaichi (JP); Takao Hata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/368,623

(22) Filed: Feb. 8, 2012

(65) Prior Publication Data

US 2012/0220173 A1 Aug. 30, 2012

(30) Foreign Application Priority Data

Feb. 28, 2011 (JP) ..... 2011-041344

(51) Int. Cl.
*H01R 13/40* (2006.01)

(52) U.S. Cl.
USPC ..... 439/595

(58) Field of Classification Search
USPC ..... 439/752.5, 595, 587, 733.1
See application file for complete search history.

(56) References Cited

U.S. PATENT DOCUMENTS

| | | | | |
|---|---|---|---|---|
| 5,743,771 | A * | 4/1998 | Yamaguchi et al. | 439/752.5 |
| 6,817,904 | B2 * | 11/2004 | Ishikawa et al. | 439/733.1 |
| 6,953,365 | B2 * | 10/2005 | Tabata et al. | 439/587 |
| 7,658,644 | B2 * | 2/2010 | Ahn | 439/587 |
| 2003/0228797 | A1 * | 12/2003 | Ishikawa et al. | 439/595 |
| 2007/0238353 | A1 | 10/2007 | Yamaoka | |

FOREIGN PATENT DOCUMENTS

| | | |
|---|---|---|
| JP | 2005-183842 | 7/2005 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A connector has a female terminal (20) with stabilizers (30) that contact restricting surfaces (64) of an edge of a terminal accommodating hole (51) at a side opposite to a side where insertion paths (60) are provided, thereby preventing any further insertion of the female terminal (20) when a female terminal (20) is inserted in a posture vertically inverted from a proper posture. Posture displacing portions (65) are provided on the restricting surfaces (64) of the terminal accommodating hole (51) and engage the stabilizers (30) of the female terminal (20) inserted in the inverted posture to displace extending postures of the stabilizers (30) to increase engaging margins with the restricting surfaces (64).

12 Claims, 16 Drawing Sheets

CONNECTOR

BACKGROUND OF THE INVENTION

1. Field of the Invention

The invention relates to a connector configured to prevent an improper insertion of a terminal fitting, such as an inverted insertion.

2. Description of the Related Art

The known waterproof connector has a terminal fitting and a rubber plug mounted on an end of a wire. The terminal fitting has a main portion and left and right stabilizers extend from opposite lateral edges of a bottom surface of the main portion. The connector also has housing formed with a cavity that includes a terminal insertion hole for closely receiving the main portion of the terminal fitting and a sealing hole adjacent the terminal insertion hole for closely receiving the rubber plug. Two insertion paths are provided in the bottom wall of the terminal insertion hole for permitting passage of the stabilizers.

The stabilizers move along the insertion paths and the rubber plug fits closely into the sealing hole to provide sealing if the terminal fitting is inserted into the cavity in a proper posture. On the other hand, the stabilizers contact an upper edge of the terminal insertion hole at a side opposite the insertion paths, if the terminal fitting is inserted in a vertically inverted posture, thereby preventing further insertion of the terminal fitting.

Reducing the diameters of the rubber plug and the sealing hole into which the rubber plug is fit has been considered to meet demands for miniaturization of such connectors. However, the projecting ends of the stabilizers must not interfere with and scratch the inner peripheral surface of the sealing hole while inserting the terminal fitting into the cavity. Japanese Unexamined Patent Publication No. 2005-183342 has left and right stabilizers aligned obliquely so that the extending ends gradually come closer to each other to avoid interference with the inner peripheral surface of the sealing hole.

However, the oblique stabilizers of an inverted terminal fitting will contact an edge portion of the terminal insertion hole and are likely to be deformed in the inclined directions Thus, sufficient engaging margins with the edge of the insertion hole cannot be ensured and the stabilizers may be inserted into the terminal insertion hole. Accordingly, an inverted insertion preventing function is not fulfilled in some cases.

The invention was completed in view of the above situation and an object thereof is to fulfill a function of preventing erroneous insertion of a terminal fitting.

SUMMARY OF THE INVENTION

The invention relates to a connector with at least one terminal fitting and a housing that has at least one cavity for receiving the terminal fitting. The terminal fitting has a main portion and at least one stabilizer extends from a surface of the main portion to prevent improper insertion, such as an inverted insertion, of the terminal fitting into the cavity. The cavity of the housing includes at least one terminal insertion hole for closely receiving the main portion of the terminal fitting and a widened entrance adjacent the terminal insertion hole. At least one insertion path is formed in a surface of the terminal insertion hole to permit passage of the stabilizer. The stabilizer is insertable to a proper position while the stabilizer passes along the insertion path when the terminal fitting is inserted in a proper posture. However, the stabilizer contacts an edge adjacent to or at an angular or azimuthal position of the terminal insertion hole different from an angular or azimuthal position where the insertion path is provided to prevent any further insertion of the terminal fitting when the terminal fitting is inserted in a posture radially displaced from the proper posture. More particularly, the stabilizer contacts an edge of the terminal insertion hole at a side opposite a side where the insertion path is provided to prevent further insertion of the terminal fitting when the terminal fitting is vertically inverted. At least one posture displacing portion is provided at or near the edge of the terminal insertion hole for engaging the stabilizer of the improperly oriented terminal fitting and displacing an extending posture of the stabilizer to increase an engaging margin with the edge.

The stabilizer engages the posture displacing portion during insertion when the terminal fitting is displaced angularly from the proper position, such as the vertically inverted posture, and is displaced in a direction to increase the engaging margin with the edge, so that the stabilizer contacts the edge. Thus, the stabilizer cannot enter the terminal insertion hole when the terminal fitting is oriented erroneously and, consequently, the stabilizer reliably fulfills an erroneous insertion preventing function.

The stabilizer of the terminal fitting may have an oblique posture and the posture displacing portion may have at least one taper surface for displacing the stabilizer toward a substantially vertical posture by contacting the stabilizer.

The obliquely aligned stabilizer is less likely to interfere with the inner peripheral surface of the entrance of the cavity. The taper surface of the posture displacing portion guides the stabilizer of an improperly oriented terminal fitting during insertion and displaces the terminal fitting to the vertical posture, i.e. the stabilizer contacts the edge of the terminal accommodating or insertion hole with a large engaging margin. Thus, an inverted insertion preventing function is fulfilled reliably while scratching by the stabilizer is suppressed when the terminal fitting is inserted in the proper posture.

Left and right stabilizers may have oblique postures so that respective extending ends gradually come closer to each other. Left and right posture displacing portions may project forward from the edge of the terminal insertion hole. Furthermore, the taper surface may be formed on an outer corner of the projecting end of each posture displacing portion.

Both stabilizers of an erroneously inserted terminal fitting contact the corresponding taper surfaces of the posture displacing portions during insertion. The stabilizers are displaced out toward vertical postures and are guided by the taper surfaces guide into contact with the edge of the terminal insertion hole while being kept in the vertical postures. Displacing the stabilizers to the vertical postures ensure large engaging margins with the edge of the hole. Additionally, the posture displacing portions are located at the inner sides of the stabilizers to prevent inward inclination of the stabilizers and to prevent further pressing of the terminal fitting.

The terminal fitting and a resilient plug are mounted on an end of a wire. The resilient plug is behind the terminal fitting and fits closely into the entrance of the cavity in the housing when the terminal fitting is inserted properly into the cavity.

The fluid- or waterproof connector reliably fulfills the function of preventing inverted insertion of the terminal fitting while suppressing scratching on the inner peripheral surface of the sealing hole by the stabilizer, i.e. ensuring sealing performance when the terminal fitting is inserted properly.

The stabilizer may be formed at a specified distance from and inward of a lateral edge of the one surface of the main portion of the terminal fitting toward a widthwise center and extends obliquely toward the widthwise center. The extending end of the stabilizer preferably is within a circumscribed circle of the main portion.

At least one C-surface may be formed on corners of the outer lateral edges of an extending end surface of the stabilizer and at least one R-surface may be formed on lateral edge of the C-surface at a base end side of the stabilizer.

The cavity may have a terminal accommodating hole that has a wide rectangular cross section for closely receiving the main portion of the terminal is to be closely fitted. A sealing hole is rearward of the terminal accommodating hole and has a circular cross section for closely receiving the resilient plug mounted on a rear end of the terminal.

The sealing hole may have the same diameter as a circumscribed circle of the main portion of the terminal.

A locking lance may be provided in the cavity of the housing to lock the terminal fitting therein. The insertion path may extend substantially in forward and backward directions adjacent to the locking lance in a lateral wall of the cavity.

Two substantially parallel insertion paths may be provided on opposite lateral sides of the locking lance in the lateral wall of the cavity and preferably extend from a tapered hole to the terminal insertion hole. The insertion paths may have closed ends near the leading end of the locking lance.

A guide groove may be formed at the outer side of the posture displacing portion for receiving the stabilizer. The guide groove may face substantially straight in a vertical direction, and a front end of the guide groove reaches the edge of the hole.

These and other objects, features and advantages of the present invention will become more apparent upon reading of the following detailed description of preferred embodiments and accompanying drawings.

DETAILED DESCRIPTION OF THE PREFERRED EMBODIMENTS

A connector in accordance with the invention of this embodiment includes two female terminals 20 fixed to respective ends of wires 10 and a female housing 40 for accommodating the female terminals 20.

Figure 1:
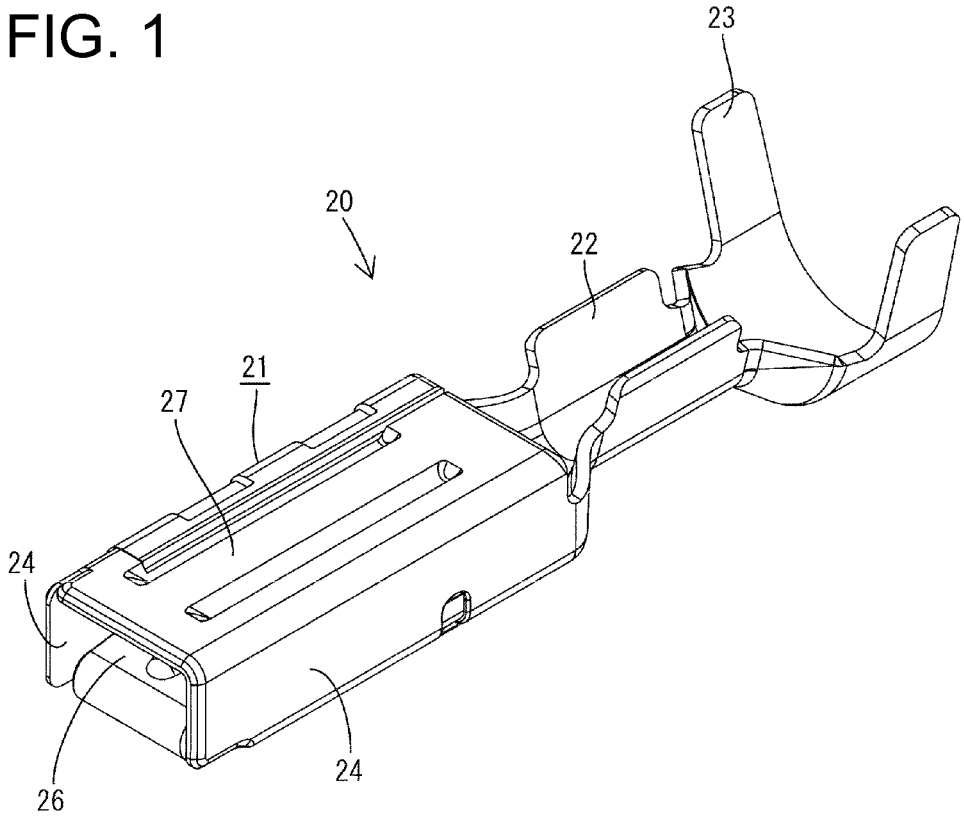
FIG. 1 is a perspective view of a female terminal according to one embodiment of the present invention.
Figure 2:
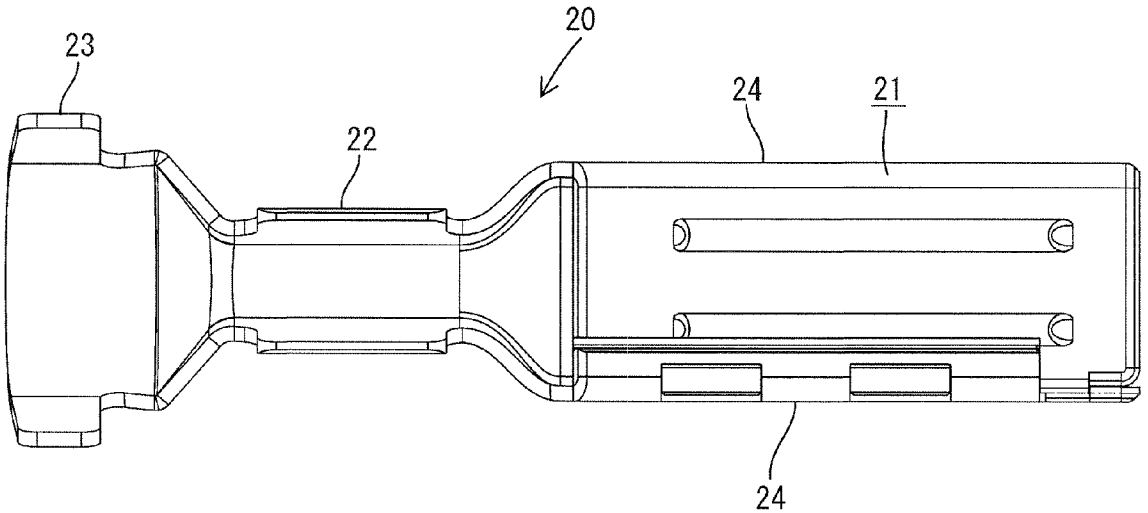
FIG. 2 is a plan view of the female terminal.

The female terminal 20, as illustrated in FIGS. 1 to 7, is formed by press-working a conductive metal plate with excellent electrical conductivity and includes a main portion 21 for receiving a tab of a mating male terminal (not shown). A wire connection portion is behind the main portion 21 and includes at least one wire barrel 22 and at least one insulation barrel 23 to be crimped, bent or folded and connected to the end of the wire 10, as shown in FIG. 1.

The main portion 21 is a rectangular tube that is long in forward and backward directions and has a wide cross section. Four corners of the main portion 21 are rounded. A resilient contact piece 26 is provided in the main portion 21 and is formed by folding a tongue extending from the front edge of a bottom plate 25 to have a mountain or pointed shape. Two elongated projections 28 are formed on the inner surface of a ceiling plate 27 by hammering. The projections 28 are long in forward and backward directions and are spaced part in a width direction The tab of the mating male terminal is inserted into the main portion 21 through a front opening and is sandwiched resiliently between the resilient contact piece 26 and the elongated projections 28 and electrical connection is established between the female terminal 20 and the male terminal.

The bottom plate 25 of the main portion 21 is formed with a lance hole 29 to be engaged with a locking lance 57 in a cavity 50 of the female housing 40. Stabilizers 30 prevent the female terminal 20 from being inserted erroneously into the cavity 50 in a vertically inverted posture. The stabilizers 30 are described later.

Figure 14:
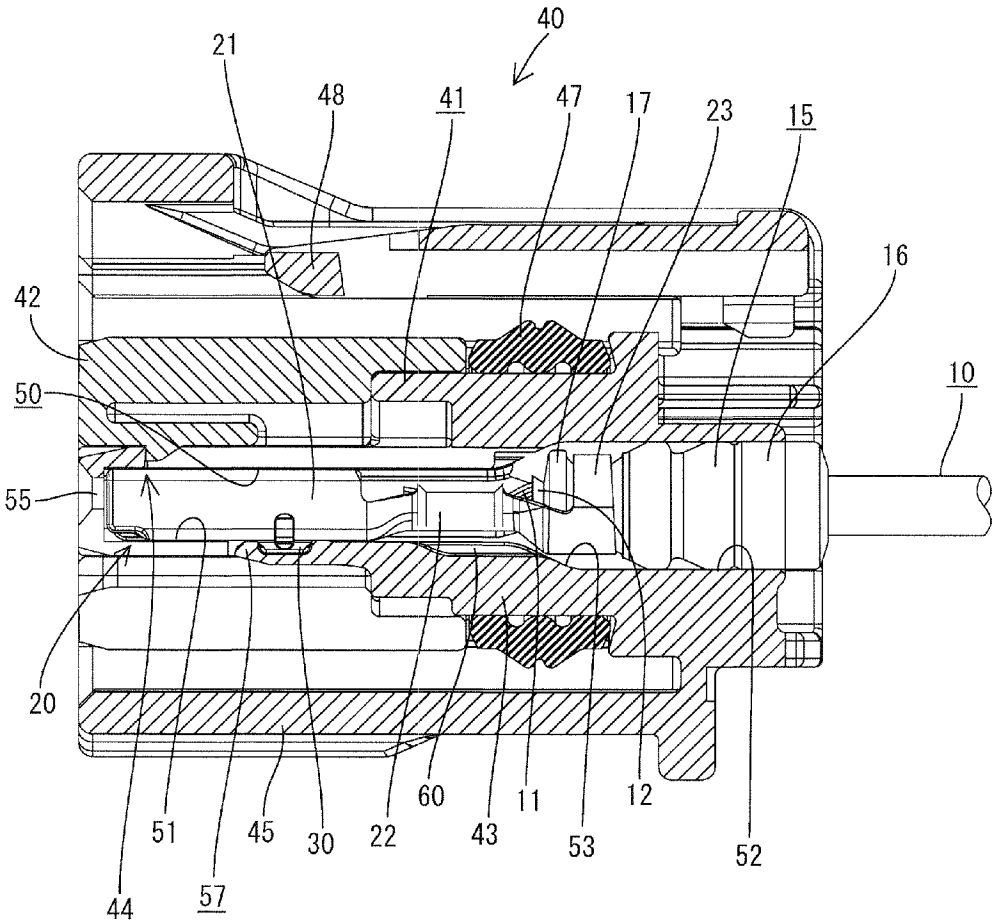
FIG. 14 is a longitudinal section when a female terminal is inserted in a proper posture.

The female terminal 20 is fixed to the end of the wire 10 together with the rubber plug 15, as shown in FIG. 14. The rubber plug 15 is long in forward and backward directions and has a plug body 16 and a mounting portion 17 on the front surface of the plug body 16. The plug body 16 has a diameter somewhat larger than that of a circumscribing circle X (see FIG. 7) of the main portion 21 of the female terminal 20. The rubber plug 15 also has a center hole for closely receiving the wire 10.

The wire barrel 22 is to be crimped, bent or folded and connected to an end of a core 11 exposed by stripping the wire 10. The insulation barrel 23 is to be crimped, bent or folded and connected to an end of an insulation coating 12 and the mounting portion 17 of the rubber plug 15. Thus, the female terminal 20 and the rubber plug 15 are mounted on the end of the wire 10.

Figure 3:
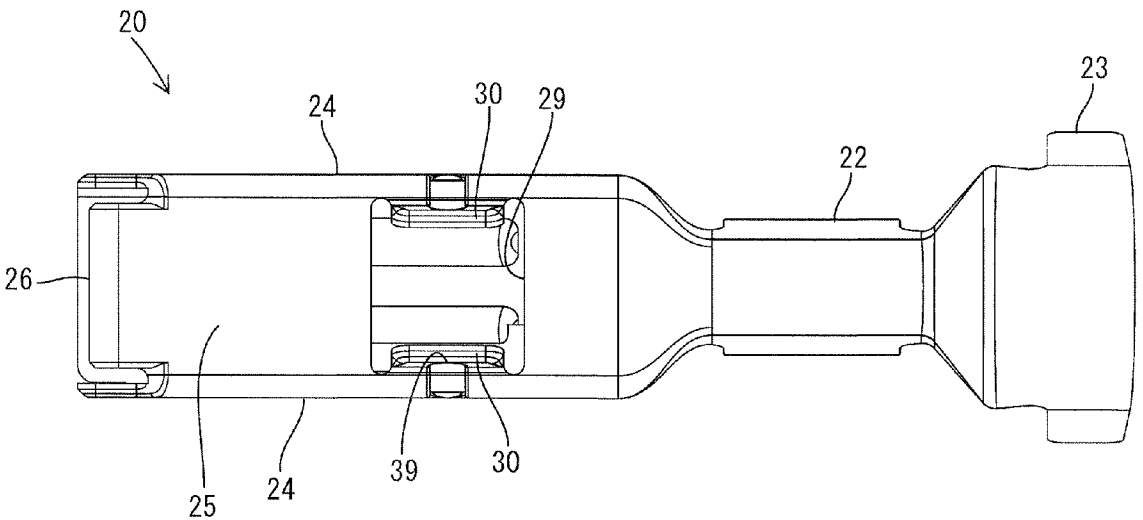
FIG. 3 is a bottom view of the female terminal.
Figure 4:
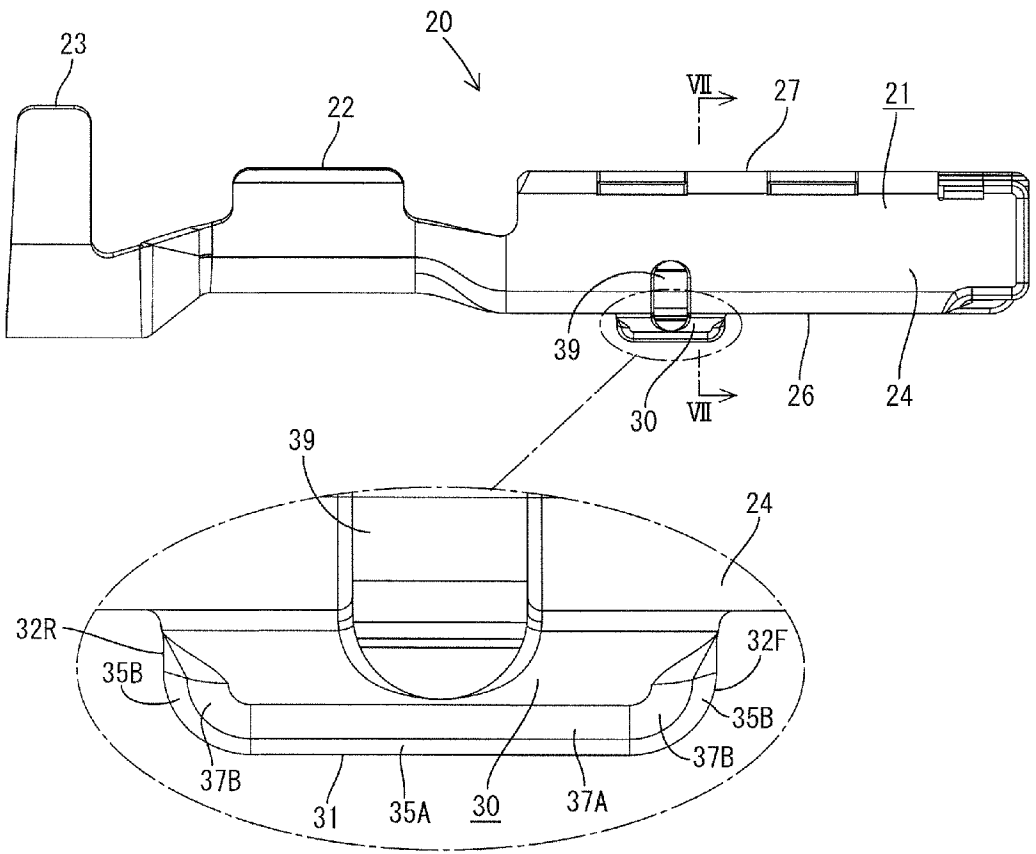
FIG. 4 is a side view of the female terminal.
Figure 5:
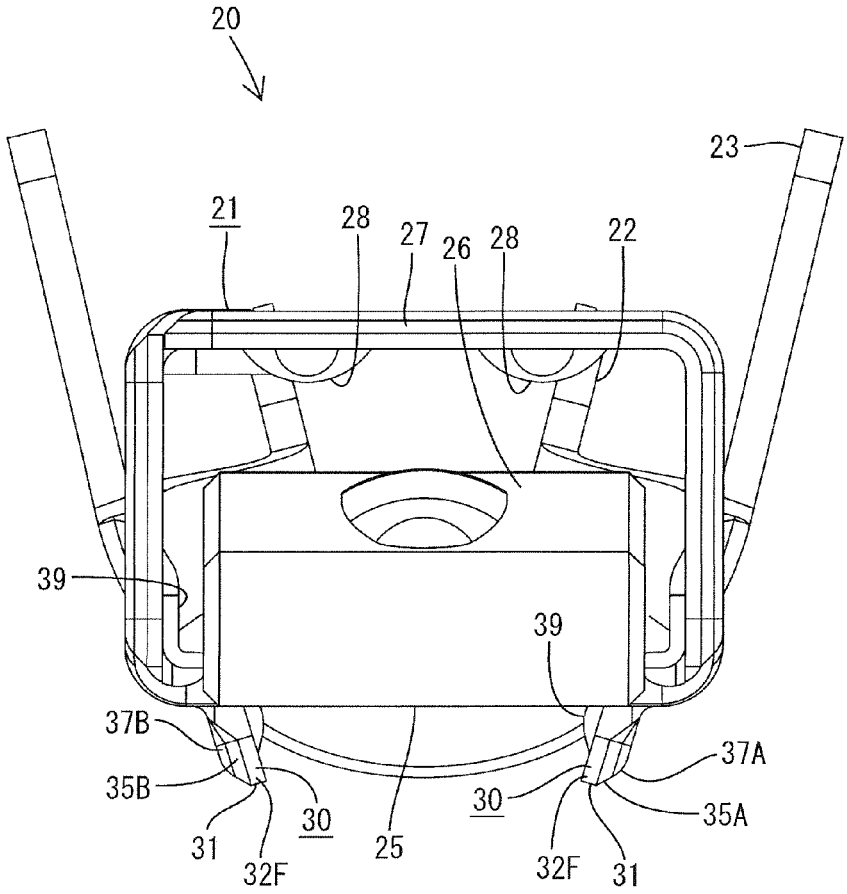
FIG. 5 is an enlarged front view of the female terminal.
Figure 6:
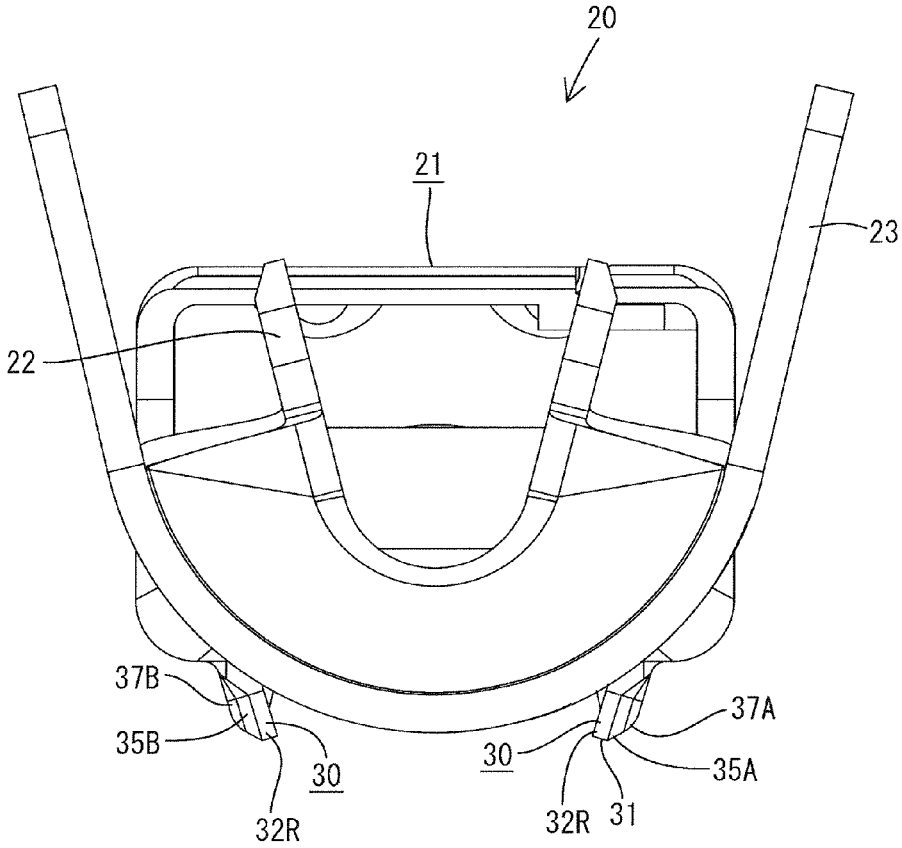
FIG. 6 is an enlarged rear view of the female terminal.

As shown in FIG. 3, the lance hole 29 is open in the bottom surface of the main portion 21 of the female terminal 20. More specifically, the lance hole 29 has a wide rectangular shape with a width substantially equal to a distance between the inner surfaces of left and right side plates 24 of the main portion 21 at a position slightly behind a lengthwise central part of the bottom surface of the main portion 21.

Figure 7:
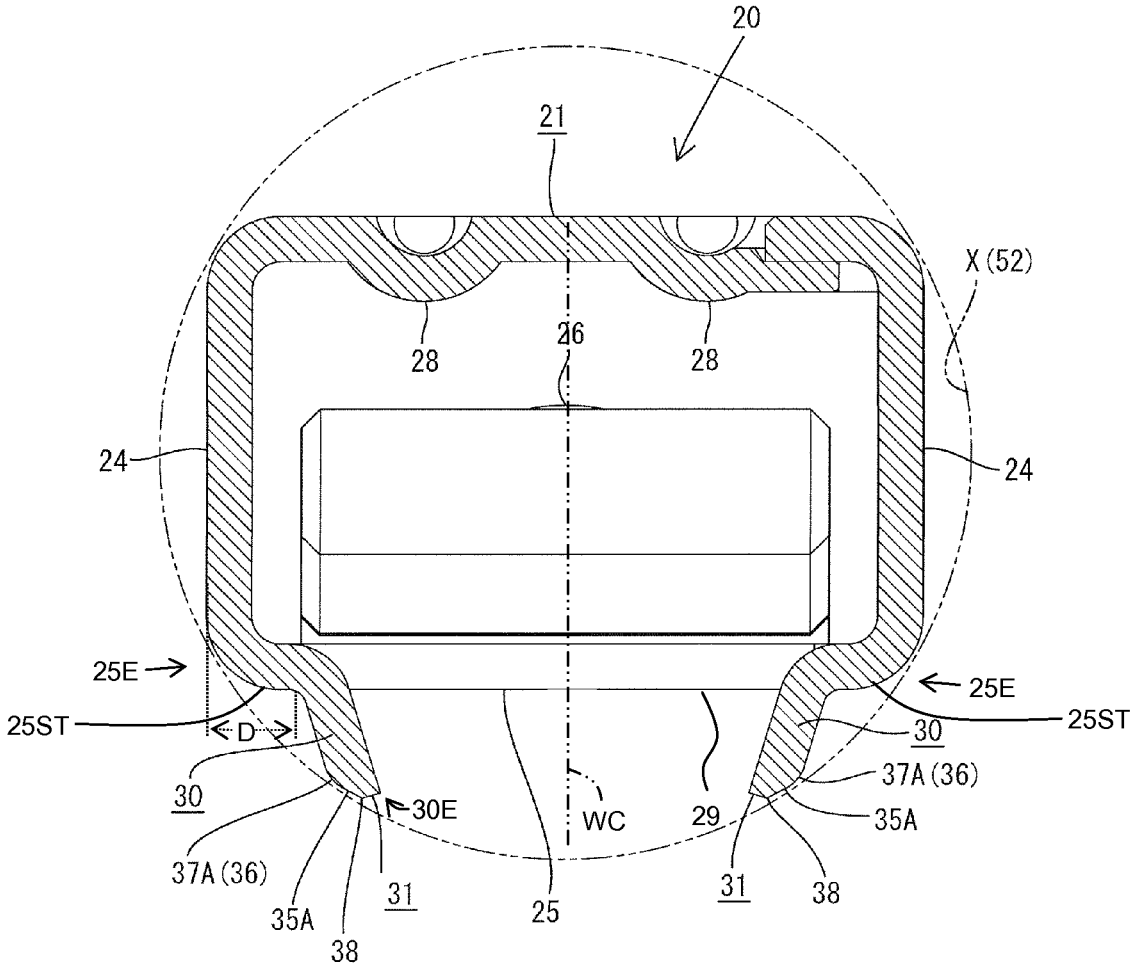
FIG. 7 is an enlarged section along VII-VII of FIG. 4.

Left and right stabilizers 30 are formed by bending cut pieces out from the left and right lateral edges of the lance hole 29. The stabilizers 30 extend at positions at a specified distance D more than about 1.5 times the thickness of the side plate 24, e.g. about twice the thickness of the side plate 24 including a bending margin from and inwardly of the opposite left and right lateral edges 25E of the bottom surface 25 of the main portion 21 toward a widthwise center WC, as shown in FIG. 7. Thus, the base end of the stabilizer 30 is spaced in from the lateral edge 25E by a distance D to form a step 25ST and the stabilizer 30 extends outwardly from the main portion 21 adjacent to the step 25ST. Furthermore, the stabilizer 30 extends obliquely with respect to the bottom surface 25 of the main portion 21 toward the widthwise center WC (defined an imaginary plane arranged in longitudinal direction of the main portion 21 and dividing the main portion 21 into two parts, see FIG. 7).

The stabilizers 30 have a width slightly shorter than the length of the lance hole 29 in forward and backward directions and a short extending dimension which is less than about half (e.g. about ¼) of the width thereof. Front and/or rear corners of the extending ends of the stabilizers 30 are rounded or beveled.

C-surfaces 35A, 35B are formed in substantially half thickness areas of the stabilizers 30 on outer corners of extending ends 30E and extend over extending end surfaces 31 and front and rear end surfaces 32F, 32R of the stabilizers 30. The C-surfaces 35A, 35B are substantially straight chamfers that are substantially straight along the forward and backward directions, see e.g. FIG. 4, and are chamfered or beveled when seen in a direction orthogonal thereto, see FIG. 7.

As shown in FIG. 7, the stabilizers 30 assume oblique postures so that their extending ends gradually come closer to each other. The extending ends 30E of both stabilizers 30 are located within the circumscribed (imaginary) circle X of the main portion 21. In other words, the stabilizers 30 are formed to be inside the imaginary circle X circumscribed around the main portion 21 of the terminal fitting 20 and tangentially contacting the corner portions of the circle X, see FIG. 7.

R-surfaces 37A are formed on lateral edges 36 at base end sides of the C-surfaces 35A, 35B formed on the outer corners. The R-surfaces 37A extend over the extending end surfaces 31 and the front and rear end surfaces 32F, 32R of the stabilizers 30, i.e. on the C-surfaces 35A. Further, R-surfaces 37B are formed on the rear edges of the C-surfaces 35B of the front end surfaces 32F and on the front edges of the C-surfaces 35B of the rear end surfaces 32R. The R-surfaces 37A, 37B are curved chamfers.

As shown in FIG. 7, forming the C-surfaces 35A on the corners of the outer lateral edges of the extending end surfaces 31 of the stabilizers 30 avoids interference of the corners with the circumscribed circle X (i.e. the stabilizers 30 are arranged inside the circle X) even if the stabilizers 30 have the extending dimension sufficient to ensure engaging margins.

Edges are still present on the opposite lateral edges of the C-surfaces 35A. However, the stabilizers 30 incline obliquely in and lateral edges 38 on the tip sides of the C-surfaces 35A are located inside the circumscribed circle X of the main portion 21 and the lateral edges 36 on the base end sides are located on the circumscribed circle X. The lateral edges 36 on the base end sides can be hammered. Thus, interference of the edges with the circumscribed circle X is avoided by forming the R-surfaces 37A on the lateral edges 36 on the base end sides of the C-surfaces 35A.

As described above, the left and right stabilizers 30 are formed by bending the cut pieces at the left and right lateral edges of the lance hole 29. Reinforcing beads 39 are formed over at least part of the stabilizers 30. Lateral edges of the lance hole 29 and the side plates 24 of the main portion 21 project outward particularly by hammering.

Figure 8:
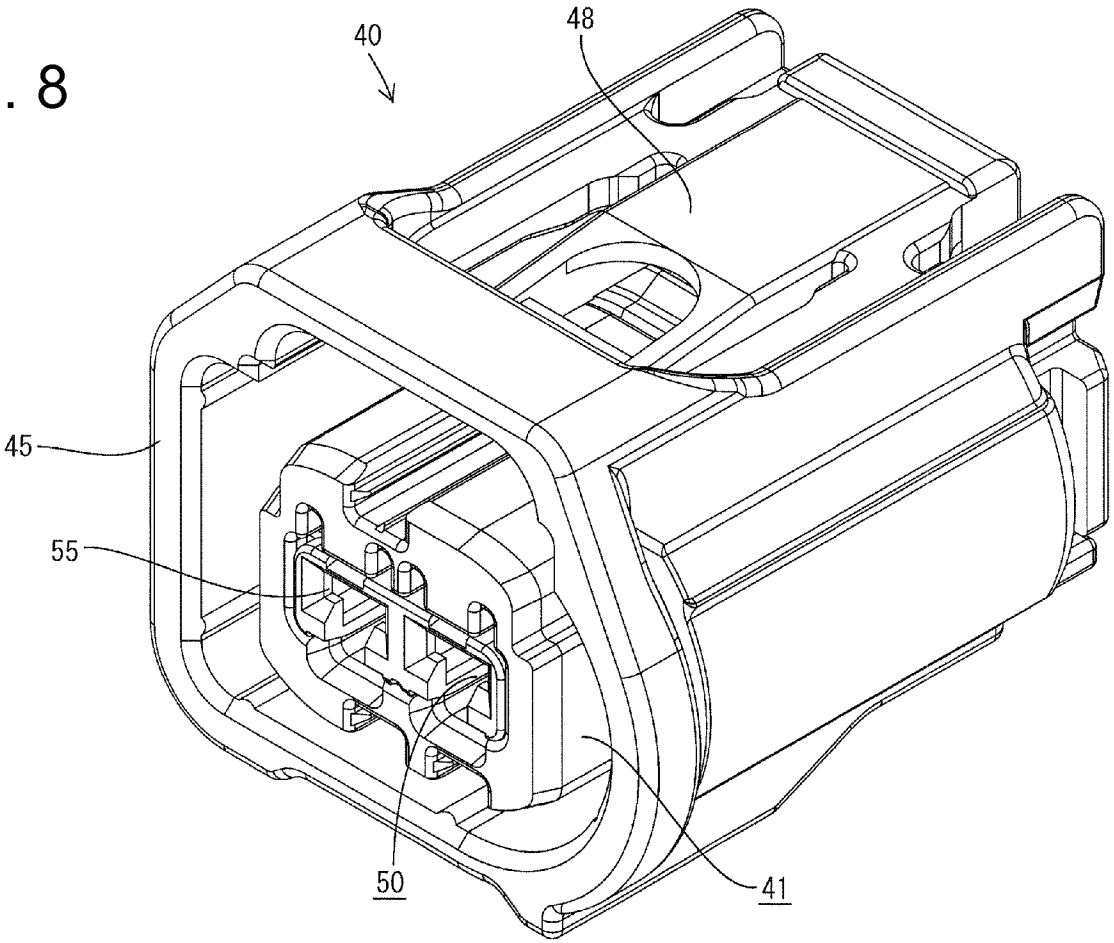
FIG. 8 is a perspective view of a female housing.
Figure 9:
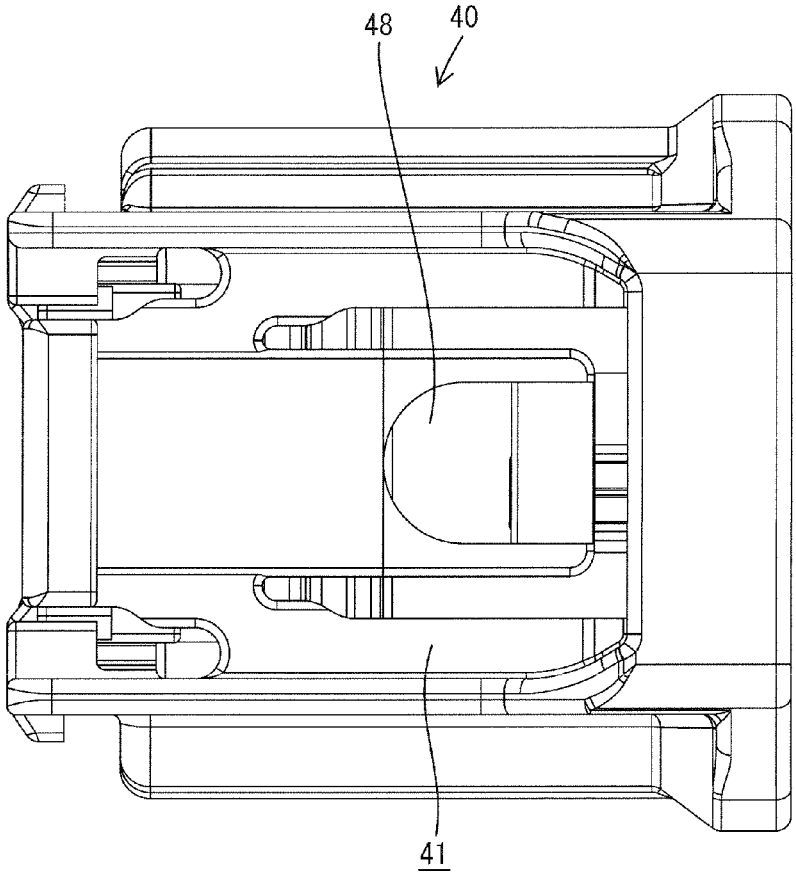
FIG. 9 is a plan view of the female housing.
Figure 10:
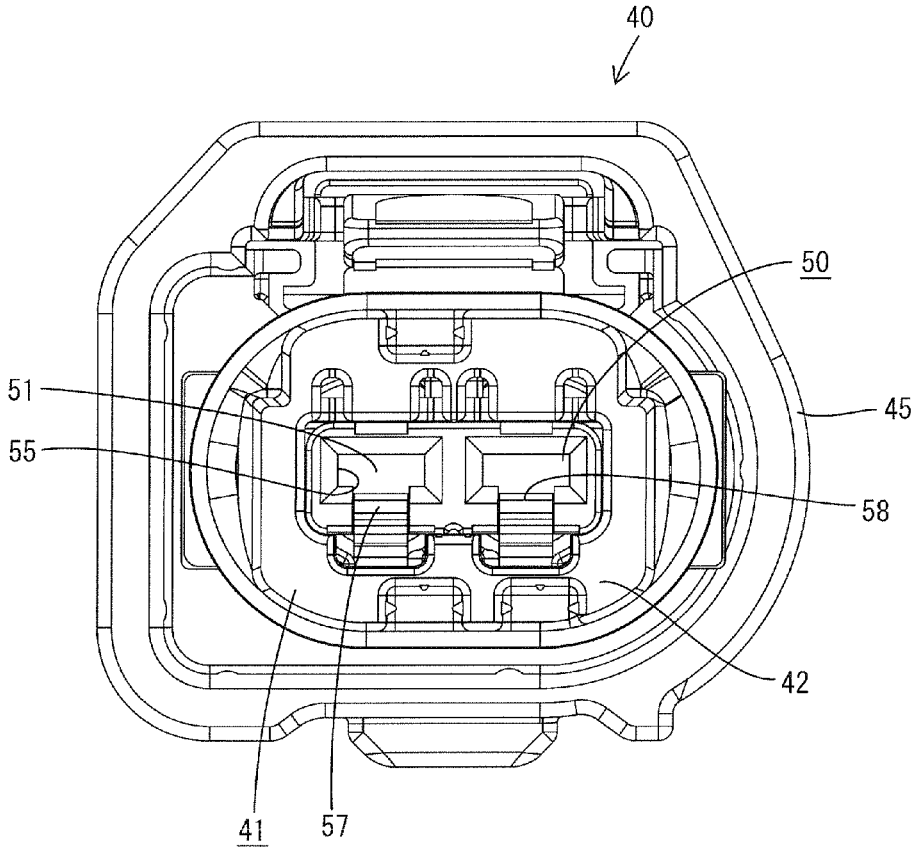
FIG. 10 is a front view of the female housing.
Figure 11:
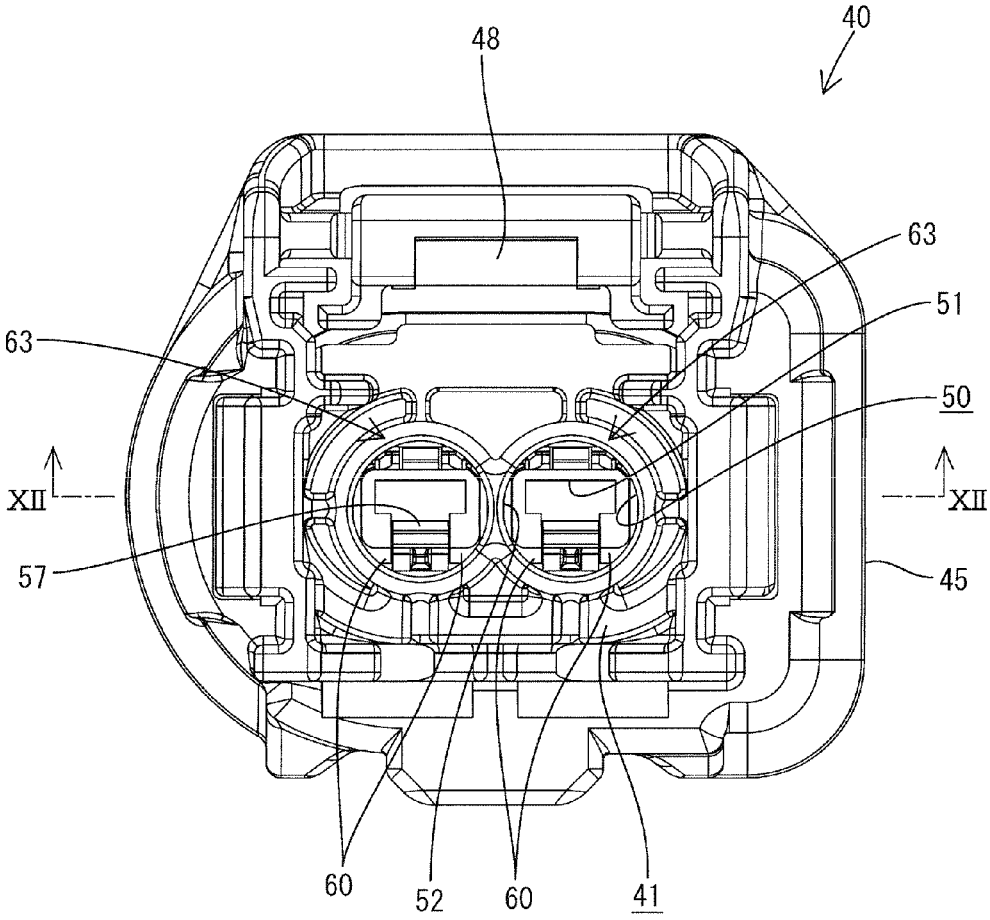
FIG. 11 is a rear view of the female housing.

The female housing 40 is made e.g. of synthetic resin and has a terminal accommodating portion 41 for receiving one or more female terminals 20, as shown in FIGS. 8 and 14. A front portion 42 of the terminal accommodating portion 41 is a separate piece integrally assembled with a rear end portion 43 via at least one lock mechanism 44. A tubular portion 45 is provided around the terminal accommodating portion 41.

The female housing 40 is connected with an unillustrated mating male housing in which male terminals are mounted. Thus, a receptacle of the male housing is inserted between the terminal accommodating portion 41 and the tubular portion 45 of the female housing 40 to provide sealing between the female housing 40 and the male housing via a seal ring 47 mounted on the base end side of the terminal accommodating portion 41. A lock arm 48 on the tubular portion 45 engages a lock of the male housing to lock the female housing 40 and the male housing in a connected state.

Two cavities 50 are formed side by side in the terminal accommodating portion 41 of the female housing 40 for receiving the above-described female terminals 20. A terminal accommodating hole 51 is formed in slightly more than the front half of each cavity 50 and has a wide rectangular cross section for closely receiving the main portion 21 of the female terminal 20. A sealing hole 52 is formed at the rear of the terminal accommodating hole 51 and has a circular cross section for closely receiving the rubber plug 15 mounted on the rear side of the female terminal 20. The sealing hole 52 has substantially the same diameter as the circumscribed circle X of the main portion 21 of the female terminal 20 described above. The rear end of the terminal accommodating hole 51 and the front end of the sealing hole 52 are connected by a tapered hole 53.

A terminal insertion opening 55 is formed in the front wall of the terminal accommodating hole 51 for receiving the tab of the male terminal. Further, a locking lance 57 is cantilevered forward from a bottom wall of the terminal accommodating hole 51. The main portion 21 of the female terminal 20 in a proper posture is inserted into the terminal accommodating hole 51 and resiliently deforms the locking lance 57. The lance hole 29 in the bottom surface of the main portion 21 of the female terminal 20 reaches the position of a projection 58 of the locking lance 57. Thus, the locking lance 57 restores resiliently so that the projection 58 fits into the lance hole 29 to lock and retain the female terminal 20.

When the female terminal 20 is inserted to the proper position, the main portion 21 and the wire barrel 22 of the female terminal 20 are accommodated in the terminal accommodating hole 51, the insulation barrel 23 of the female terminal 20 and the mounting portion 17 of the rubber plug 15 are accommodated in the tapered hole 53 and the front end of the sealing hole 52 and a front part of the plug body 16 of the rubber plug 15 is accommodated in the rear of the sealing hole 52, as shown in FIG. 14.

Substantially parallel insertion paths 60 are formed in the bottom wall of the cavity 50 and extend in forward and backward directions at opposite left and right sides of the locking lance 57. The insertion paths 60 extend from the tapered hole 53 to the terminal accommodating hole 51 and can receive the left and right stabilizers 30 projecting from the bottom surface of the main portion 21 of the female terminal 20.

A restriction 63 is formed at an upper edge of the terminal accommodating hole 51 including the ceiling wall of the tapered hole 53 for contacting the stabilizers 30 when the female terminal 20 is inserted in an improper posture for preventing any further insertion of the female terminal 20.

Figure 12:
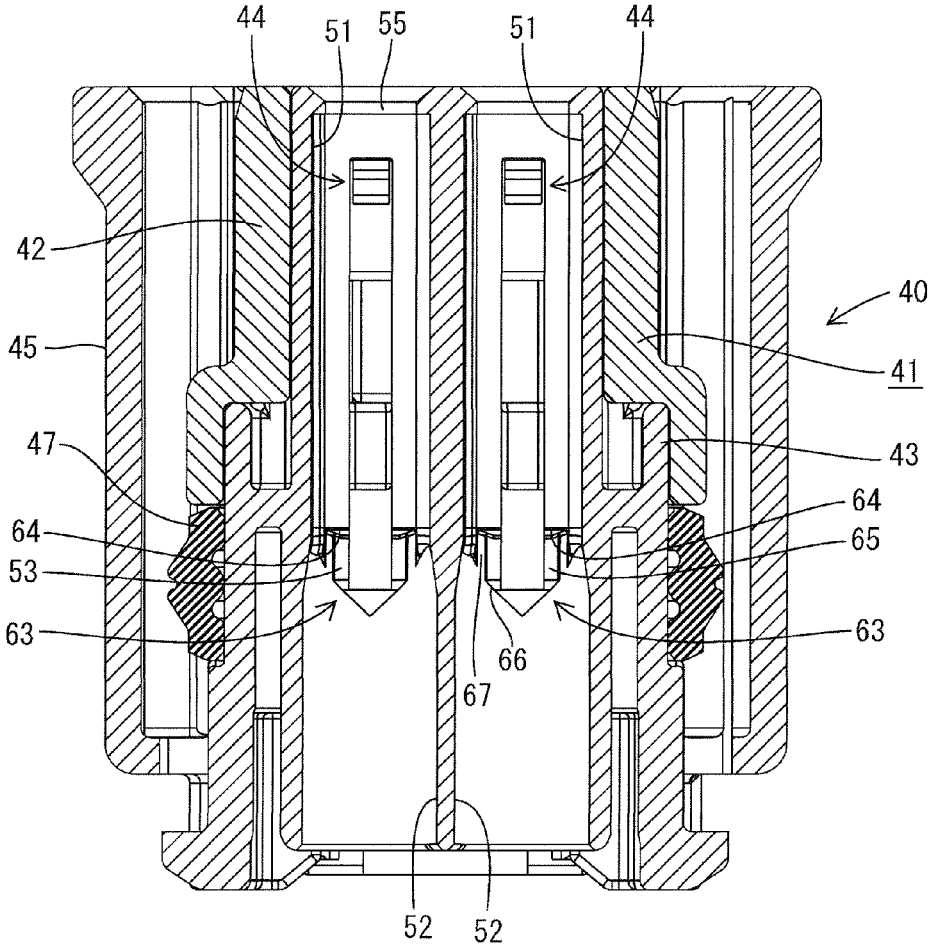
FIG. 12 is a section along XII-XII of FIG. 11.
Figure 13:
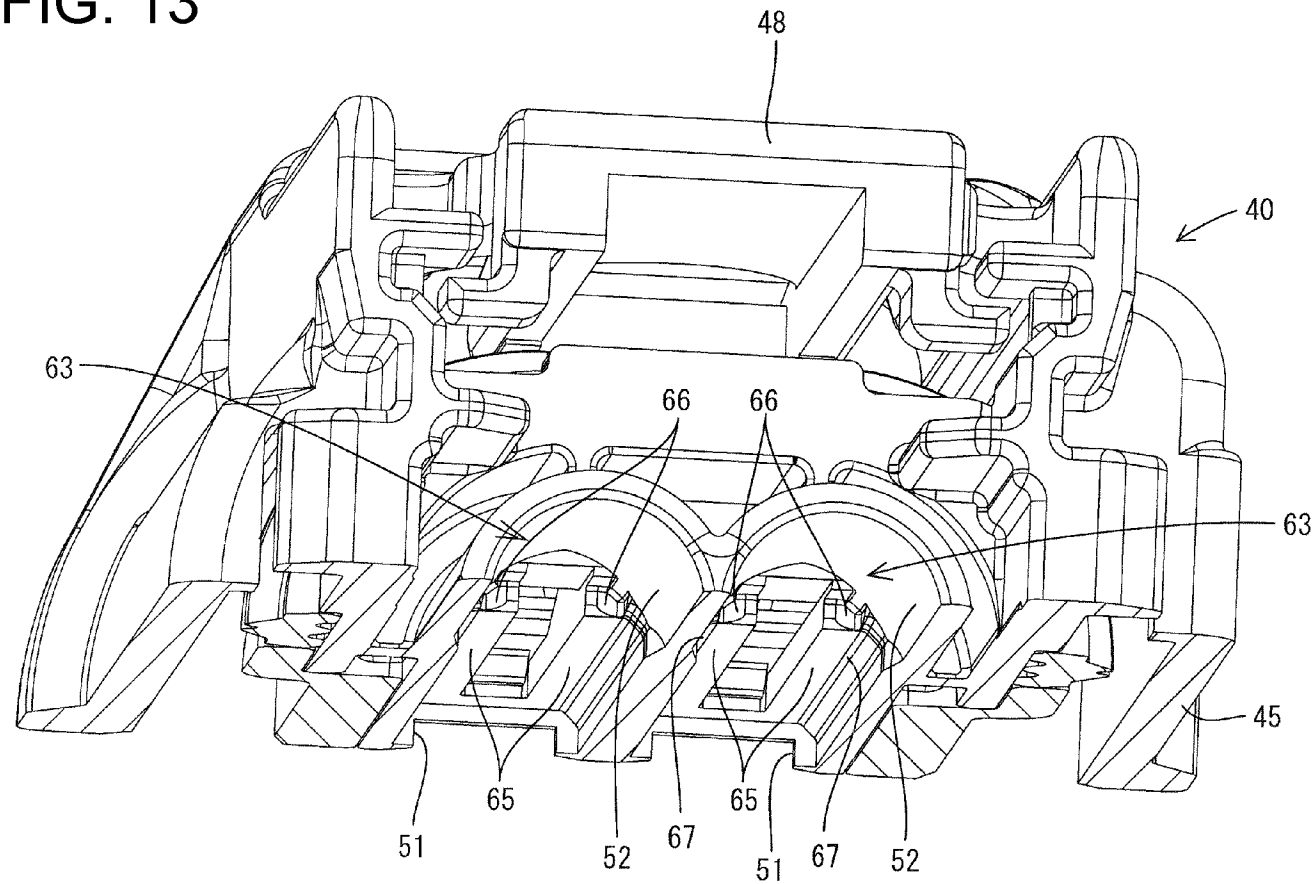
FIG. 13 is a perspective view partly in section along XII-XII of FIG. 11.

The restriction 63 is described in detail with reference to FIGS. 12 and 13. Restricting surfaces 64 are formed at an upper edge of the terminal accommodating hole 51 at positions slightly behind a connecting part of the terminal accommodating hole 51 with the tapered hole 53 and are at an angle, preferably substantially perpendicular to an axial direction. Posture displacing portions 65 in the form of left and right rectangular bars are formed substantially parallel to each other to project back (toward the sealing hole 52) from the restricting surfaces 64.

Taper surfaces 66 are formed at outer corners of the end surfaces of the respective posture displacing portions 65. The respective taper surfaces 66 are formed at positions where the left and right stabilizers 30 contact the taper surfaces 66 when the female terminal 20 is in the vertically inverted posture. Guide grooves 67 for receiving the stabilizers 30 are formed at the outer sides of the respective posture displacing portions 65 to face substantially straight in a vertical direction, and the back ends of the respective guide grooves 67 reach the restricting surfaces 64.

The female terminal 20 is inserted into the corresponding cavity 50 of the female housing 40 with the stabilizers 30 located at the lower side, as shown in FIG. 14.

The stabilizers 30 also pass through the sealing hole 52. There is a concern that extending ends of the stabilizers 30 may catch the lower hole edge of the sealing hole 52, for example, due to upward inclination of the main portion 21. However, the C-surfaces 35B and the R-surfaces 37B formed on the outer corner portions of the front end surfaces 32F of the stabilizers 30 smoothly guide the stabilizers 30 into the sealing hole 52.

The main portion 21 of the female terminal 20 including the stabilizers 30 then is pushed while sliding substantially in contact with the inner peripheral surface of the sealing hole 52. At that time, there is a concern that the lateral edges 36 on the base end sides of the C-surfaces 35A formed on the extending end surfaces 31 of the stabilizers 30 will contact the inner peripheral surface of the sealing hole 52 as shown in FIG. 7. However, the R-surfaces 37A are formed on the lateral edges 36 will not scratch the inner peripheral surface of the sealing hole 52.

When the female terminal 20 is pushed further, such as by pushing the rear end of the rubber plug 15, the front end of the main portion 21 is inserted into the terminal accommodating hole 51 while being guided by the tapered hole 53. Additionally, the main portion 21 is pushed into the terminal accommodating hole 51 in the intermediate position or middle of insertion while the stabilizers 30 are inserted into the corresponding insertion paths 60, as shown on the right side of FIG. 16. The main portion 21 is pushed to the proper position and contacts the front wall of the terminal accommodating hole 51, as shown in FIG. 14. Thus, the locking lance 57 resiliently returns and fits into the lance hole 29 to retain the female terminal 20 in the terminal accommodating hole 51. Simultaneously, the front part of the plug body 16 of the rubber plug 15 is fit closely into the rear end portion of the sealing hole 52 to seal the cavity 50.

Figure 15:
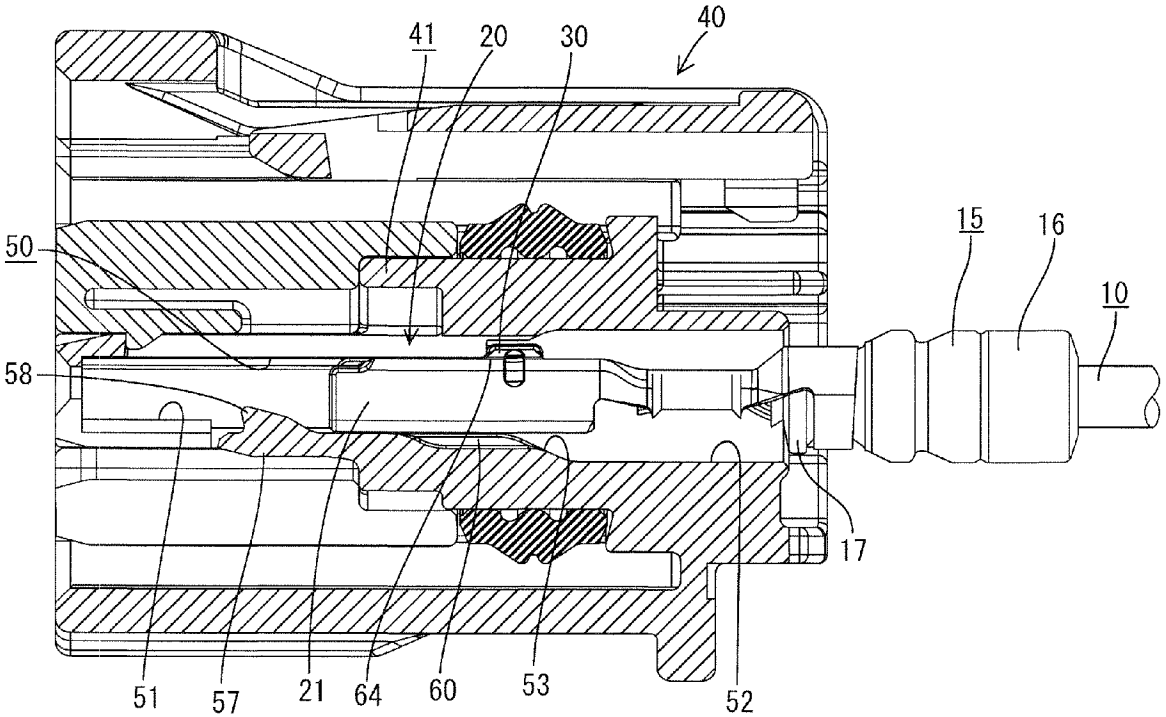
FIG. 15 is a longitudinal section when the female terminal is inserted in an inverted posture.
Figure 16:
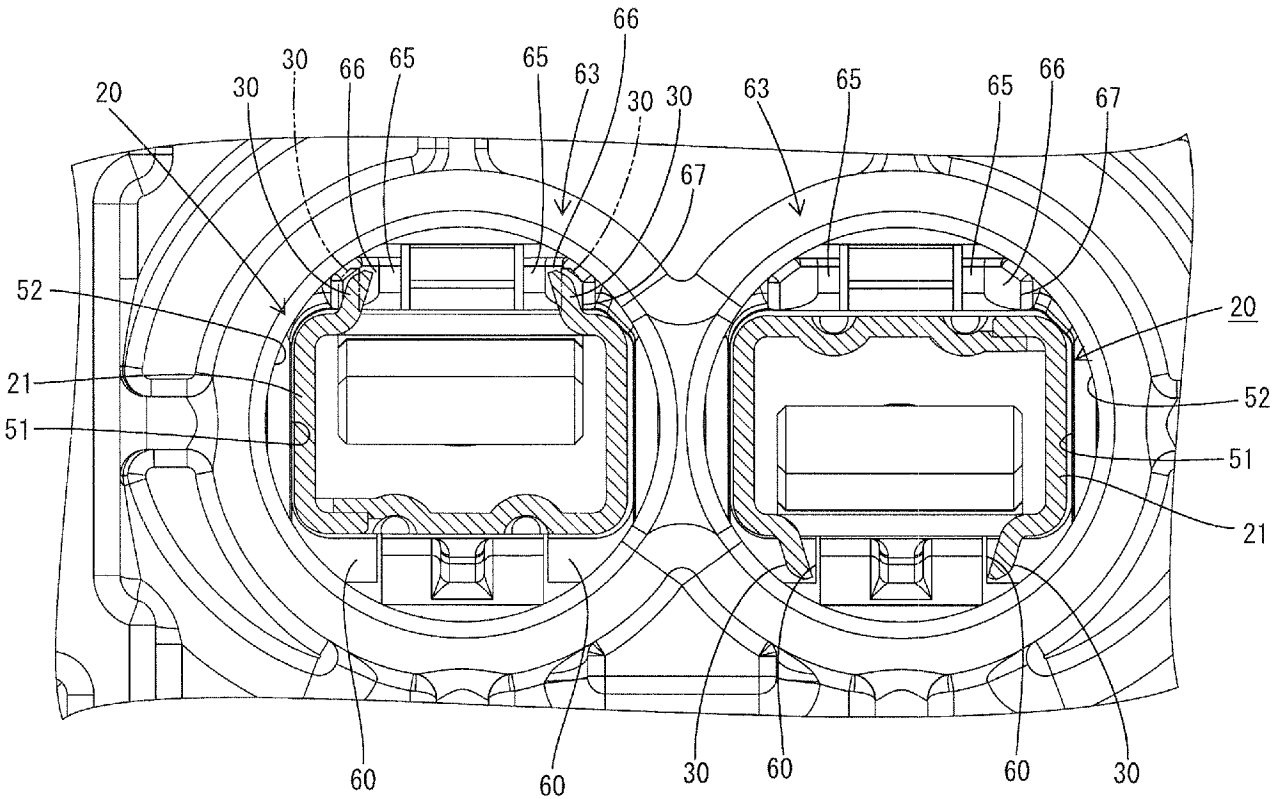
FIG. 16 is an enlarged rear view of a part where a cavity is formed.

On the other hand, if the female terminal 20 is inserted in an improper posture, such as a vertically inverted posture where the stabilizers 30 are located at the upper side, as shown in FIG. 15, the extending ends of the both stabilizers 30 contact taper surfaces 66 of the corresponding posture displacing portions 65, as shown on the left side of FIG. 16, at a timing at which the main portion 21 is guided by the tapered hole 53 and enters the terminal accommodating hole 51. If the female terminal 20 is pushed farther, the stabilizers 30 are displaced to vertical postures by being guided by the taper surfaces 66, as shown by chain line in FIG. 16, pass in the guide grooves 67 at the outer sides of the posture displacing portions 65 while being kept in the vertical postures and then come into contact with the restricting surfaces 64, as shown in FIG. 15.

Further pushing of the female terminal 20 is prevented in the above manner and insertion of the female terminal 20 in a wrong posture is detected. Large engaging margins with the restricting surfaces 64 are ensured by displacing the stabilizers 30 to the vertical postures, and inward inclination of the stabilizers 30 is prevented by the posture displacing portions 65 at the inner sides of the stabilizers 30. Thus, the pushing of the female terminal 20 is prevented reliably.

Since the rubber plug 15 is not fitted in the sealing hole 52 when the pushing is prevented in the above manner, the female terminal 20 can be pulled back easily, such as by holding the rubber plug 15 and pulling the wire 10 backward. Thereafter, the female terminal 20 may be corrected to the proper posture and inserted again into the cavity 50.

According to this embodiment, the left and right stabilizers 30 for preventing improper insertion, such as inverted insertion, are provided on the bottom surface of the main portion 21 and the extending ends of the stabilizers 30 are located within the circumscribed (imaginary) circle X of the main portion 21. Additionally, the stabilizers 30 are at the specified distance D in from the left and right edges 25E of the bottom surface 25 of the main portion 21 of the female terminal 20 toward the widthwise center WC and are aligned obliquely so that the extending ends 30E gradually come closer to each other. Furthermore, the C-surfaces 35A are formed at the corners of the outer lateral edges of the extending end surfaces 31 of the stabilizers 30 and the R-surfaces 37A are formed on the lateral edges 36 of the C-surfaces 25A on the base end sides of the stabilizers 30.

As a result, the stabilizers will not scratch the inner peripheral surface of the sealing hole 52 in the cavity 50 when the female terminal 20 is being inserted into the cavity 50 in a proper posture. However, both stabilizers 30 have the oblique postures and are inclined in toward each other. Thus, there is a slight possibility that the engaging margins are small or that the inclined stabilizers 30 will deform so that the stabilizers 30 enter the terminal accommodating hole 51 if the female terminal 20 is inserted in an inverted posture and contact the edge of the terminal accommodating hole 51.

However, the restrictions 63, including the posture displacing portions 65 and the like, are formed at the upper edge of the terminal accommodating hole 51 contact the stabilizers 30 when the female terminal 20 is inserted erroneously. More particularly, the extending ends of the stabilizers 30 contact the corresponding taper surfaces 66 of the posture displacing portions 65 when the main portion 21 of the inverted female terminal 20 enters the terminal accommodating hole 51. If the female terminal 20 is pushed further, the stabilizers 30 are displaced to the vertical postures by the taper surfaces 66, pass in the respective guide grooves 67 at the outer sides of the posture displacing portions 65 while kept in the vertical postures, and then contact the respective restricting surfaces 64.

Thus, large engaging margins with the restricting surfaces 64 are ensured by displacing the stabilizers 30 to the vertical postures and the insertion of the female terminal 20 is prevented reliably by the posture displacing portions 65 at the inner sides of the stabilizers 30 preventing inward inclination of the stabilizers 30.

As a result, the individual waterproof female connector reliably fulfills a function of preventing improper or inverted insertion of the female terminal 20 while preventing the stabilizers 30 from scratching the inner peripheral surface of the sealing hole 52 to ensure sealing performance when the female terminal 20 is inserted properly.

The invention is not limited to the above described and illustrated embodiment. For example, the following embodiments also are included in the scope of the invention.

The stabilizers that assume the oblique postures are displaced to the vertical postures in the above embodiment. However, the postures of the stabilizers before and after the displacements do not matter as long as the engaging margins with the edge of the terminal accommodating hole increase after the displacements.

The stabilizers are provided on the bottom surface of the main portion of the female terminal in the above embodiment. However, the number and arrangement positions of the stabilizers may be other than those described above.

The illustrated embodiment shows a female waterproof connector with female terminals accommodated in a female housing. However, the invention is similarly applicable to male fluid- or waterproof connectors in which one or more male terminals are accommodated in a male housing.

The present invention can be applied widely to waterproof connectors including a one-piece resilient plug or rubber plug and even non-waterproof connectors, i.e. connectors in general that are of a type that a terminal fitting including a stabilizer for preventing improper or inverted insertion in a cavity of a housing.

What is claimed is:

1. A connector, comprising at least one terminal fitting and a housing with at least one cavity into which the terminal fitting is inserted, wherein:

the terminal fitting is formed with a main portion and at least one stabilizer extending from a surface of a main portion for preventing improper insertion, the stabilizer having an oblique alignment to a surface of the main portion;

the cavity of the housing includes at least one terminal insertion hole into which the main portion of the terminal fitting is closely fit, a widened entrance at an end of the terminal insertion hole, and at least one insertion path in a surface of the terminal insertion hole to permit passage of the stabilizer;

the stabilizer is insertable along the insertion path to a proper position when the terminal fitting is inserted in a proper posture, whereas the stabilizer contacts an edge of the housing angularly offset from the insertion path to prevent further insertion of the terminal fitting when the terminal fitting is inserted in an improper posture angularly displaced from the proper posture; and at least one posture displacing portion near the edge of the terminal insertion hole for displacing the stabilizer from the oblique alignment to the surface of the main portion toward a normal alignment to the surface of the main portion to increase an engaging margin of the stabilizer when the terminal fitting inserted in the improper posture.

2. The connector of claim 1, wherein the posture displacing portion has at least one taper surface for contacting the stabilizer and displacing the stabilizer toward the normal alignment to the surface of the main portion.

3. The connector of claim 2, wherein:

the at least one stabilizer comprises left and right stabilizers aligned obliquely to the surface so that extending ends gradually approach each other; and the at least one posture displacing portion comprises left and right posture displacing portions projecting forward from the edge of the terminal insertion hole.

4. The connector of claim 3, wherein the taper surface is formed on an outer corner portion of the projecting end of each posture displacing portion.

5. The connector of claim 1, wherein:

the terminal fitting and a resilient plug are mounted on an end of a wire, the resilient plug being located behind the terminal fitting; and the resilient plug is closely fittable into an entrance of the cavity in the housing when the terminal fitting is inserted properly into the cavity.

6. The connector of claim 1, wherein the cavity is formed with a terminal accommodating hole having a wide rectangular cross section configured for closely receiving the main portion of the terminal, and a sealing hole formed at a rear end of the terminal accommodating hole, the sealing hole having a circular cross section configured for closely receiving the resilient plug.

7. The connector of claim 6, wherein the sealing hole has a diameter substantially equal to a diameter of a circumscribed circle of the main portion of the terminal.

8. The connector of claim 1, wherein a locking lance is provided in the cavity of the housing to lock the terminal fitting inserted therein, and wherein the insertion path extends in substantially forward and backward directions in a lateral wall of the cavity and substantially adjacent to the locking lance.

9. The connector of claim 8, wherein the at least one insertion path comprises two substantially parallel insertion paths at opposite lateral sides of the locking lance in the lateral wall of the cavity, the insertion paths extending substantially from a tapered hole to the terminal insertion hole and having closed ends near the leading end of the locking lance.

10. A connector, comprising at least one terminal fitting and a housing with at least one cavity into which the terminal fitting is inserted, wherein the terminal fitting is formed with a main portion and at least one stabilizer extending from a surface of a main portion for preventing improper insertion, the stabilizer extends from a position at a specified distance in from a lateral edge of the surface of the main portion of the terminal fitting toward a widthwise center to assume an oblique posture toward the widthwise center, the extending end of the stabilizer being within a circumscribed circle of the main portion;

the cavity of the housing includes at least one terminal insertion hole into which the main portion of the terminal fitting is closely fit, a widened entrance at an end of the terminal insertion hole, and at least one insertion path in a surface of the terminal insertion hole to permit passage of the stabilizer;

the stabilizer is insertable along the insertion path to a proper position when the terminal fitting is inserted in a proper posture, whereas the stabilizer contacts an edge of the housing angularly offset from the insertion path to prevent further insertion of the terminal fitting when the terminal fitting is inserted in an improper posture angularly displaced from the proper posture; and at least one posture displacing portion near the edge of the terminal insertion hole for displacing the stabilizer to increase an engaging margin of the stabilizer when the terminal fitting inserted in the improper posture.

11. The connector of claim 10, wherein at least one C-surface is formed on corner portions of outer lateral edges of an extending end surface of the stabilizer and at least one R-surface is formed on lateral edge of the C-surface on a base end side of the stabilizer.

12. A connector, comprising at least one terminal fitting and a housing with at least one cavity into which the terminal fitting is inserted, wherein the terminal fitting is formed with a main portion and at least one stabilizer extending from a surface of a main portion for preventing improper insertion;

the cavity of the housing includes at least one terminal insertion hole into which the main portion of the terminal fitting is closely fit, a widened entrance at an end of the terminal insertion hole, and at least one insertion path in a surface of the terminal insertion hole to permit passage of the stabilizer;

the stabilizer is insertable along the insertion path to a proper position when the terminal fitting is inserted in a proper posture, whereas the stabilizer contacts an edge of the housing angularly offset from the insertion path to prevent further insertion of the terminal fitting when the terminal fitting is inserted in an improper posture angularly displaced from the proper posture; and at least one posture displacing portion near the edge of the terminal insertion hole for displacing the stabilizer to increase an engaging margin of the stabilizer when the terminal fitting inserted in the improper posture, a guide groove at an outer side of the posture displacing portion and facing substantially straight in a vertical direction, the stabilizer being insertable in the guide groove, and an end of the guide groove reaching the edge of the terminal insertion hole.

* * * * *